US010087745B2

(12) United States Patent
Gottlieb et al.

(10) Patent No.: US 10,087,745 B2
(45) Date of Patent: Oct. 2, 2018

(54) BORE OBJECT CHARACTERIZATION SYSTEM FOR WELL ASSEMBLIES

(71) Applicant: Cameron International Corporation, Houston, TX (US)

(72) Inventors: Emanuel J. Gottlieb, Pittsburgh, PA (US); Andrew Jaffrey, Oldmeldrum (GB); Donald R. Augenstein, Pittsburgh, PA (US); Salvador Reyes, III, Houston, TX (US)

(73) Assignee: Cameron International Corporation, Houston, TX (US)

( * ) Notice: Subject to any disclaimer, the term of this patent is extended or adjusted under 35 U.S.C. 154(b) by 166 days.

(21) Appl. No.: 14/697,389

(22) Filed: Apr. 27, 2015

(65) Prior Publication Data

US 2016/0312603 A1 Oct. 27, 2016

(51) Int. Cl.

| | |
|---|---|
| ***E21B 47/09*** | (2012.01) |
| ***E21B 33/06*** | (2006.01) |
| ***E21B 47/08*** | (2012.01) |

(52) U.S. Cl.

CPC ..... *E21B 47/091* (2013.01); *E21B 33/06* (2013.01); *E21B 47/082* (2013.01)

(58) Field of Classification Search

CPC ..... E21B 47/091
USPC ..... 367/82, 82.1
See application file for complete search history.

(56) References Cited

U.S. PATENT DOCUMENTS

| | | | | |
|---|---|---|---|---|
| 4,747,305 | A | 5/1988 | Evans et al. | |
| 4,753,444 | A | 6/1988 | Jackson et al. | |
| 5,156,636 | A | 10/1992 | Kuljis | |
| 5,750,896 | A | 5/1998 | Morgan et al. | |
| 6,720,764 | B2 | 4/2004 | Relton et al. | |
| 6,815,945 | B2 | 11/2004 | Biester et al. | |
| 7,246,522 | B1 | 7/2007 | Diaz et al. | |
| 7,274,989 | B2 | 9/2007 | Hopper | |
| 7,665,543 | B2 | 2/2010 | Bostick et al. | |
| 7,819,183 | B2 | 10/2010 | Borgstadt | |
| 7,841,414 | B1 | 11/2010 | Borgstadt | |
| 7,866,403 | B1 | 1/2011 | Borgstadt | |
| 7,971,638 | B2 | 7/2011 | Borgstadt | |
| 7,997,340 | B2 | 8/2011 | Bostick et al. | |
| 8,065,937 | B2 | 11/2011 | Halse | |
| 8,485,067 | B2 | 7/2013 | Pietras et al. | |
| 2002/0121369 | A1* | 9/2002 | Allen | E21B 47/0001 166/242.1 |
| 2008/0186805 | A1 | 8/2008 | Han | |
| 2010/0207711 | A1* | 8/2010 | Estes | E21B 47/082 333/24 C |
| 2013/0153212 | A1* | 6/2013 | Myers | E21B 40/00 166/250.01 |

(Continued)

*Primary Examiner* — Qutbuddin Ghulamali
(74) *Attorney, Agent, or Firm* — Helene Raybaud

(57) ABSTRACT

An apparatus for characterizing objects in the bore of a well assembly is provided. In one embodiment, the apparatus includes a sensing array including ultrasonic transducers and a data analyzer coupled to receive input from the sensing array. The sensing array is positioned to transmit ultrasonic waves into the bore of a well assembly and to receive ultrasonic waves from the bore. The data analyzer processes data representative of ultrasonic waves received by the sensing array to identify a location of a component in the bore. Additional systems, devices, and methods are also disclosed.

18 Claims, 7 Drawing Sheets

(56) References Cited

U.S. PATENT DOCUMENTS

| | | | | |
|---|---|---|---|---|
| 2015/0007651 | A1 | 1/2015 | Reyes, III et al. | |
| 2016/0258282 | A1 * | 9/2016 | McClung, III | E21B 47/12 |

* cited by examiner

BORE OBJECT CHARACTERIZATION SYSTEM FOR WELL ASSEMBLIES

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include a wellhead assembly mounted on a well through which the resource is accessed or extracted. These wellhead assemblies may include a wide variety of components, such as casings, hangers, blowout preventers, fluid conduits, pumps, and the like, that facilitate drilling or production operations. In offshore systems, risers are often used to couple the wellhead assembly to a vessel at the surface of the water. Drill strings and other objects pass into wells through bores of the wellhead assemblies (and of the risers, if present) to facilitate drilling or testing of the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to detection of objects present within bores of well assemblies. For instance, certain embodiments concern detecting drill string tool joints within a blowout preventer or a riser coupled to a well. In one example, a sensing array is provided in a blowout preventer stack for detecting and characterizing objects within the bore of the blowout preventer stack. The sensing array includes ultrasonic transducers positioned about the bore of the blowout preventer stack. Ultrasonic waves emitted into and received from the bore can be used to determine the presence, location, and size of objects within the bore. A sensing array can also or instead be provided in a riser of the well assembly. In some embodiments, a well assembly includes multiple sensing arrays to detect objects at different axial locations along its bore. In addition to determining a radial position of an object (e.g., a tool joint) within the bore, the sensing arrays can be used for determining an axial position of the object within the bore.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As described in greater detail below, certain embodiments of the present disclosure generally relate to a detection system that detects and characterizes the position, shape, and size of objects, such as drill string tool joints, within the bore of a blowout preventer or a subsea riser. The detection system can include ultrasound transducers provided around the circumference of the bore and controlled such that each transducer can function in pulse-echo mode or pitch-catch mode. In one such embodiment, when objects pass in front of an ultrasonic beam the transducer echo is used to locate the position of an external point of the object as coordinates on a Cartesian grid that is mapped on the cross-section of the bore. Detecting three such points of the object about its outer perimeter allows a circle to be fit to the points, while detecting five external points allows an ellipse to be fit to the points. Once the location of the object has been detected, the size of the object is determined from the geometry. The detection system can be calibrated for changes in the velocity of sound within the bore. Further, the detection system can be used to determine the speed and direction of travel of an object within the bore. In at least some embodiments, the detection system can be used to perform bore object location and other characterization in the presence of various materials in the bore, including drilling mud, rock fragments, sand, gas, and oil.

Figure 1:
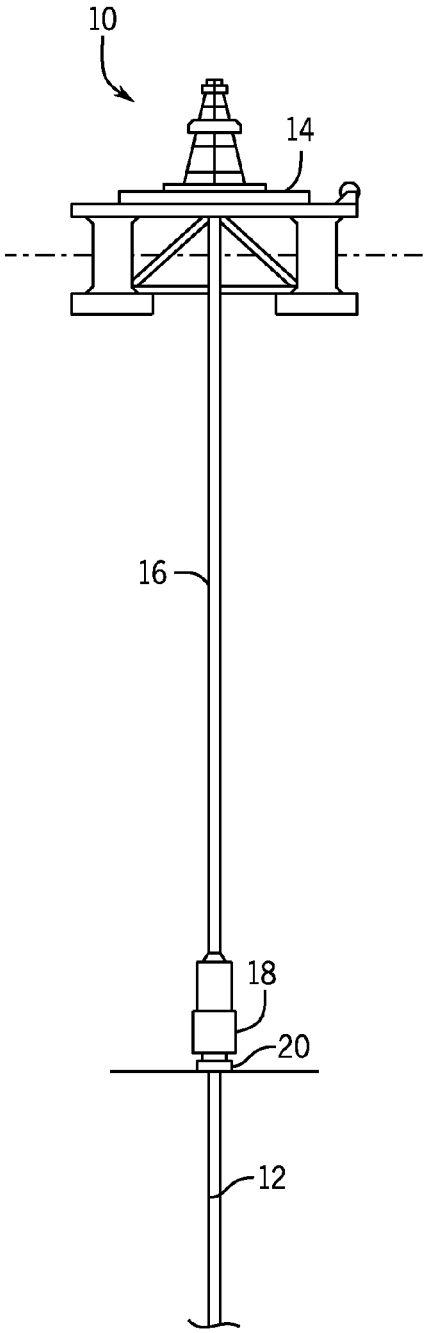
FIG. 1 generally depicts a well apparatus in the form of an offshore drilling system with a drilling rig coupled by a riser to a wellhead assembly in accordance with one embodiment of the present disclosure.

Turning now to the present figures, a well assembly or apparatus 10 is illustrated in FIG. 1 in accordance with one embodiment. The apparatus 10 (e.g., a drilling system or a production system) facilitates access to or extraction of a resource, such as oil or natural gas, from a reservoir through a well 12. The apparatus 10 is generally depicted in FIG. 1 as an offshore drilling apparatus including a drilling rig 14 coupled with a riser 16 to a wellhead assembly 18 installed at the well 12. Although shown here as an offshore system, the well apparatus 10 could instead be an onshore system in other embodiments.

As will be appreciated, the drilling rig 14 can include surface equipment positioned over the water, such as pumps, power supplies, cable and hose reels, control units, a diverter, a gimbal, a spider, and the like. Similarly, the riser 16 may also include a variety of components, such as riser joints, flex joints, a telescoping joint, fill valves, and control units, to name but a few. The wellhead assembly 18 includes equipment, such as blowout preventers, coupled to a wellhead 20 to enable the control of fluid from the well 12. Any suitable blowout preventers could be coupled to the wellhead 20, such as ram-type preventers and annular preventers. The wellhead 20 can also include various components, such as casing heads, tubing heads, spools, and hangers.

Figure 2:
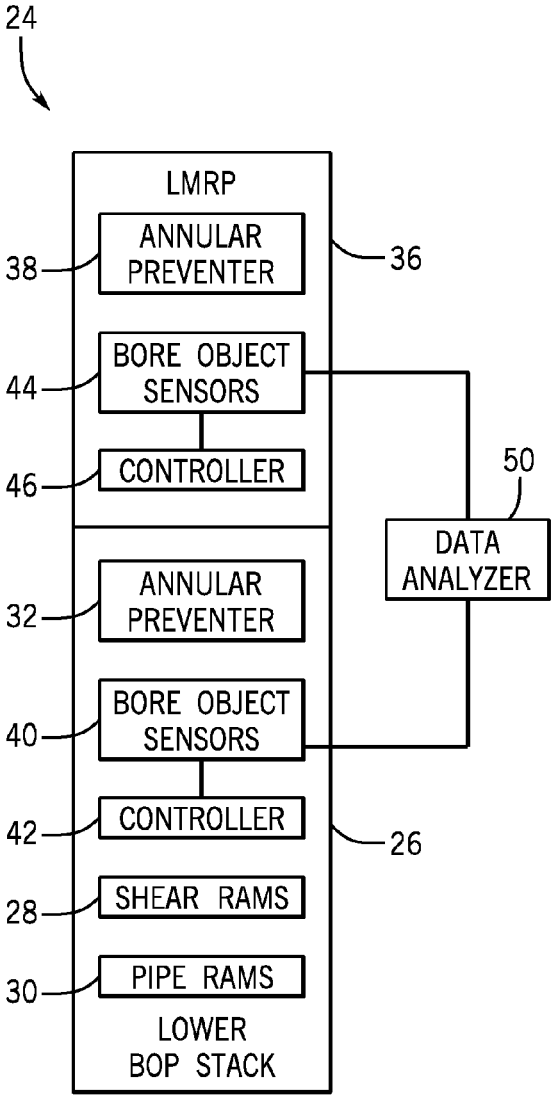
FIG. 2 is a block diagram depicting a blowout preventer stack assembly of the apparatus of FIG. 1 having bore object sensors in accordance with one embodiment.

An example of the wellhead assembly 18 is generally depicted in FIG. 2 as a subsea blowout preventer stack assembly 24. The stack assembly 24 includes a lower blowout preventer stack 26 that can be coupled above the wellhead 20. The lower blowout preventer stack 26 includes ram-type preventers (e.g., represented as shear rams 28 and pipe rams 30) and an annular preventer 32. The blowout preventer stack assembly 24 is further shown in FIG. 2 as including a lower marine riser package (LMRP) 36 having an annular preventer 38. It will be appreciated that the lower blowout preventer stack 26 and the LMRP 36 can include other components in addition to or in place of those depicted in FIG. 2. The LMRP 36, for example, can include control pods for controlling operation of the preventers of the lower blowout preventer stack 26 and the LMRP 36. Additionally, in some embodiments (e.g., onshore embodiments) the LMRP 36 is omitted from the blowout preventer stack assembly 24.

A bore through the blowout preventer stack assembly 24 allows objects, such as a drill string, to pass into the well 12. The drill string and other objects may routinely pass through the bore of the blowout preventer stack assembly 24 (and the riser 16) during normal operations. Examples of other objects that may pass through the stack assembly 24 include reamers, downhole assemblies, running tools, and other tools. The blowout preventer stack 26 includes bore object sensors 40 for monitoring the interior of the bore. As discussed in greater detail below, the bore object sensors 40 can be used to characterize objects (e.g., the drill string) present in the bore within the stack 26. The sensors 40 can be operated by a controller 42. In some embodiments, the sensors 40 are provided as one or more planar arrays of inwardly facing ultrasonic transducers provided about the bore of the stack 26 to emit and receive ultrasonic waves from the bore, while the controller 42 controls timing and sequence of the emitted waves. The LMRP 36 includes bore object sensors 44 and a controller 46, which may function similarly as the sensors 40 and controller 42 to enable characterization of objects present in the bore. The controllers 42 and 46 could be provided as separate devices or could be integrated into a single device that controls operation of both the sensors 40 and the sensors 44. Bore object sensors (and associated controllers) can also or instead be provided elsewhere in the apparatus 10, such as along the bore of the riser 16 or of the wellhead 20.

A data analyzer 50 is coupled to receive data from the bore object sensors and processes the data to detect and characterize objects within the bore of the apparatus 10, which can include determining the sizes, shapes, and positions of the objects in the bore. The data analyzer 50 could be positioned with one or more of the bore object sensors or provided remote from any of these sensors. In one subsea embodiment, the data analyzer is provided at the surface on the drilling rig 14. The controllers 42 and 46 could be integrated with the data analyzer 50 as one processor-based system that both controls operation of the bore object sensors and analyzes data obtained with the sensors, or could be provided separate from the data analyzer 50 (e.g., as local controllers 42 and 46).

Figure 3:
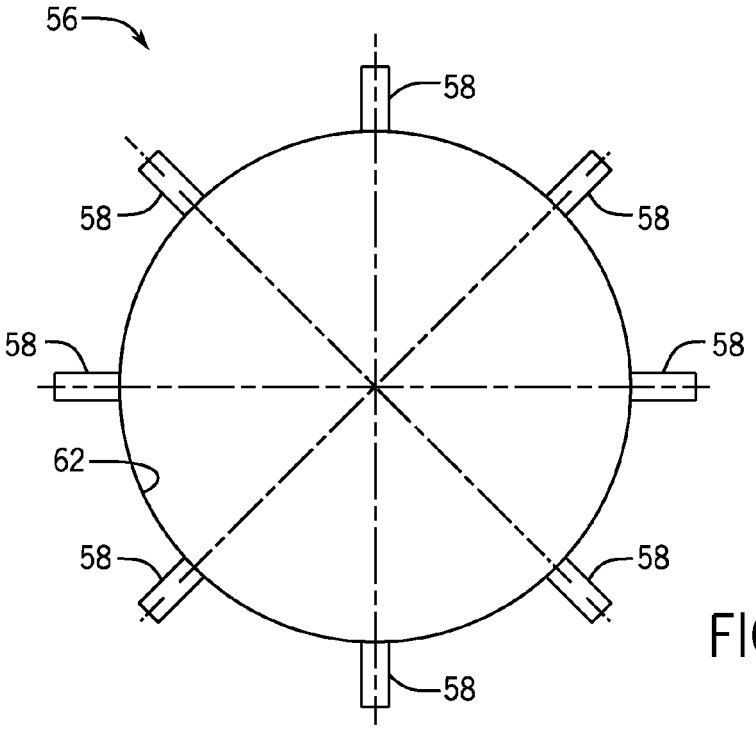
FIG. 3 shows a planar sensing array having ultrasonic transducers that may be used as the bore object sensors of FIG. 2 in accordance with one embodiment.

In some embodiments, the bore object sensors 40 and 44 are provided as planar sensing arrays 56 that include ultrasonic transducers 58, as depicted in FIG. 3 by way of example. The ultrasonic transducers 58 are positioned circumferentially about the bore 62 of the well apparatus 10 (e.g., in the blowout preventer stack assembly 24 or the riser 16). The sensing array 56 can be provided at an axial location along the bore 62 such that the transducers 58 are in contact with the bore and lie in a common, cross-sectional plane across the bore. This allows use of the sensing array 56 to detect a drill string or other objects that intersect the plane (which may be referred to as a sensing plane) in the bore 62. While certain examples below describe detection and characterization of a drill string, the present techniques can be used to detect and characterize other objects in a bore of a well assembly. For example, bore object sensors can be used to detect and characterize running tools used in a wellhead (e.g., in a drilling adapter of the wellhead).

The ultrasonic transducers 58 are inwardly facing (e.g., facing toward the central axis of the bore 62) to emit ultrasonic waves into the bore 62. Any suitable ultrasonic transducers 58 could be used, such as single-element, dual-element, annular, linear, or phased-array transducers. Further, the ultrasonic transducers 58 can emit ultrasonic waves of any suitable frequency (e.g., 40 kHz-5 MHz, inclusive); in some instances, the ultrasonic transducers 58 will emit ultrasonic waves within a frequency range of 40 kHz to 200 kHz, inclusive. The selected frequency can depend on various factors, such as the diameter of the bore 62, the characteristics of fluid (e.g., drilling mud) within the bore, and the acoustic beam angle of the transducers 58. The beam angle for the transducers can be varied as desired, such as by changing aperture sizes for the array 56 via switching circuitry, to facilitate detection of objects within the bore. Further, the transducers 58 can be placed in one or more protective housings, such as individual housings for each transducer 58 or a common housing shared by the transducers 58 of a given sensing array 56. The protective housings isolate the transducers 58 from fluid and pressure within the bore 62.

Figure 4:
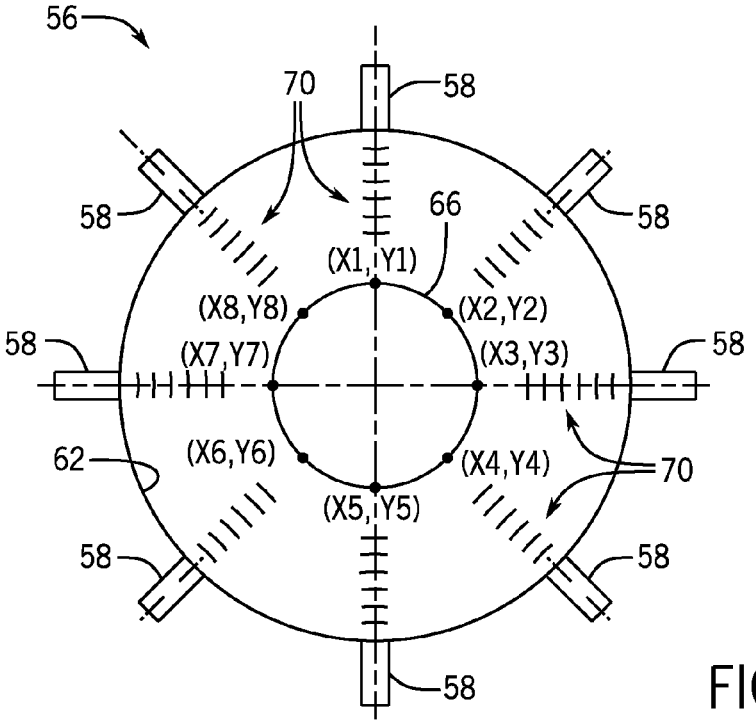
FIG. 4 depicts ultrasonic waves in the bore and a drill string passing perpendicularly through the sensing plane of the planar sensing array of FIG. 3 in accordance with one embodiment.

In at least some embodiments, data from the planar sensing array 56 can be used by the data analyzer 50 to determine the presence, location, and geometry of a drill string 66 (or another object) at a cross-sectional sensing plane in the bore 62. In FIG. 4, the drill string 66 is shown centered within the bore 62 for explanatory purposes. It will be appreciated, however, that the radial location of the drill string 66 could be anywhere within the area of the bore 62.

A coordinate system can be mapped to the sensing plane to facilitate determination of the location and size of detected objects within the bore 62. For example, in one embodiment a Cartesian coordinate system is mapped to the sensing plane with the origin of the coordinate system at the center of the bore 62 in the plane, although other coordinate systems (e.g., a polar coordinate system) could be used in different embodiments. Each of the transducers 58 is placed such that the position (its x-y coordinates) of the transducer is known. The transducers 58 can transmit and receive ultrasonic signals (i.e., waves) 70 continuously in pitch-catch mode until the beam is broken. Once the beam is broken the radial location of the drill string 66 or other object (with respect to the central axis of the bore 62) and its geometry can be calculated by the data analyzer 50.

In a Cartesian coordinate system, the (x, y) coordinates of a circle are defined by:

$$(x-a)^2+(y-b)^2=r^2,$$

where (a, b) is the location of the center of the circle and r is the radius of the circle. Further, three known points along the circumference of a circle allow a circle with radius r to be fit to the points. Using a pulse-echo technique, the distance traveled by an ultrasonic wave is equal to the product of the velocity of the wave and the time elapsed between sending and receiving of the wave. In the case of an ultrasonic wave emitted by a transducer 58, reflected from the drill string 66, and received by the same transducer 58, the distance from the transducer 58 to the exterior surface of the drill string 66 is half the total distance traveled by the wave. For example, a transducer 58 located on the lower half of the y-axis of the coordinate system (e.g., the lowermost transducer 58 in FIGS. 3 and 4) along the circumference of a bore 62 with an eighteen-inch diameter can be ascribed a location of (0, −9). A circle having a three-inch radius and whose center is located at (0, 0) has a point (0, −3) on its circumference. Using the pulse-echo technique, the data analyzer 50 can calculate that the distance to the point on the circle (which can correspond to the exterior perimeter of the drill string 66 in the sensing plane) is six inches from the transducer, thus the coordinate of that point on the circle is (0, −3). In the same manner, other exterior points of the drill string 66 in the sensing plane can be located by the data analyzer 50 with data from other transducers 58.

Figure 5:
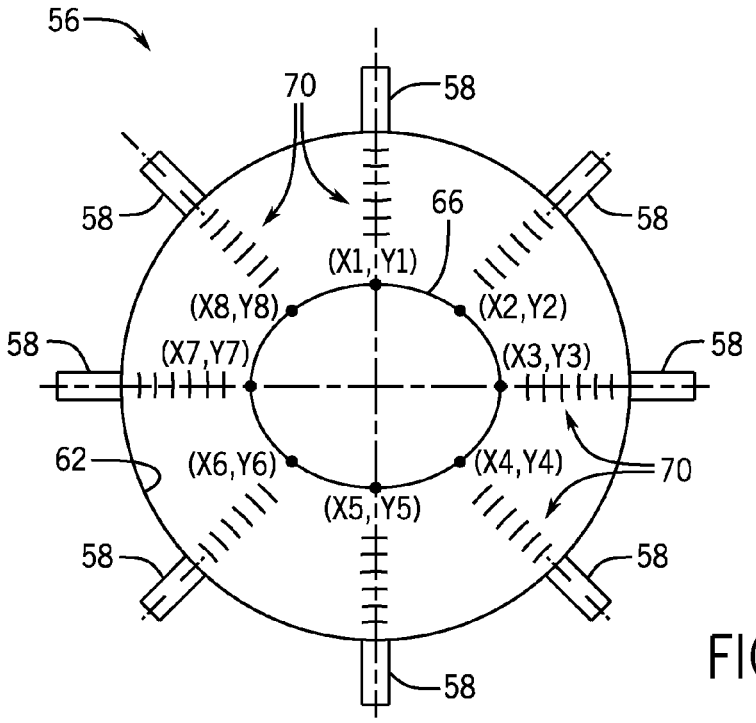
FIG. 5 depicts ultrasonic waves in the bore and a drill string passing through the sensing plane of the planar sensing array of FIG. 3 at a non-perpendicular angle in accordance with one embodiment.

The same methodology can be applied to other shapes, such as a non-circular ellipse. If, as generally depicted in FIG. 5, the drill string 66 (or other bore object) is not perpendicular to the ultrasonic beams then the shape of a circular object across the plane is an ellipse. Five known points along the perimeter of an ellipse allow an ellipse with major and minor axes to be fit to the known points, with the ellipse defined as:

$$(x-a)^2/h^2+(y-b)^2/k^2=1,$$

where h is the radius along the x-axis, k is the radius along the y-axis and (a, b) is the center.

In at least some embodiments, each of the transducers 58 emits ultrasonic signals having an acoustic signature that identifies the signals as having been emitted from a particular transducer 58. This acoustic signature can be a variation in the number of pulses, the frequency, or any other suitable aspect of the signal that allows identification of the source of the signals once received. When an ultrasonic signal from one transducer 58 echoes from an object in the bore and is received by another transducer 58, the known initial direction of the signal, the known positions of the sending and receiving transducers 58, and the elapsed travel time of the signal in the bore can be used by the data analyzer 50 to determine the reflection point on the exterior of the object within the bore.

Figure 6:
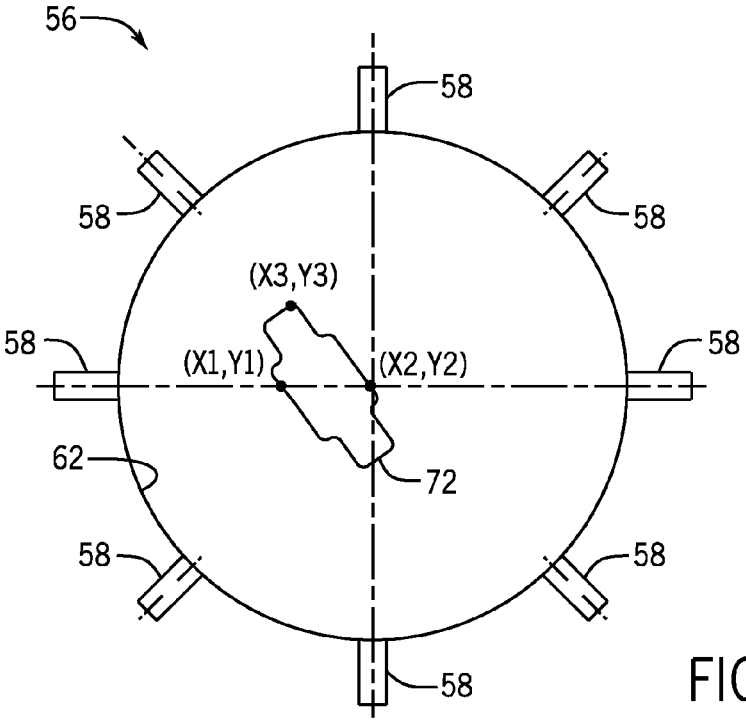
FIG. 6 depicts a non-circular bore object that can be characterized using the planar sensing array of FIG. 3 in accordance with one embodiment.

The present techniques could also be used to detect objects having a non-circular and non-elliptical cross-sectional profile within the bore 62. In FIG. 6, for example, an exterior profile of an object 72 is depicted within the bore 62. Various points on the exterior of the object 72 within the sensing plane of the sensing array 56 can be determined as generally described above. If the external profile of the object 72 is already known (e.g., from a database of shapes and dimensions of objects run into the bore 62), the profile can be fit to the determined exterior points to allow the position and orientation of the object 72 in the sensing plane to be determined. In other cases, the external profile of the object 72 could be inferred from the determined points on the exterior of the object 72.

Figure 7:
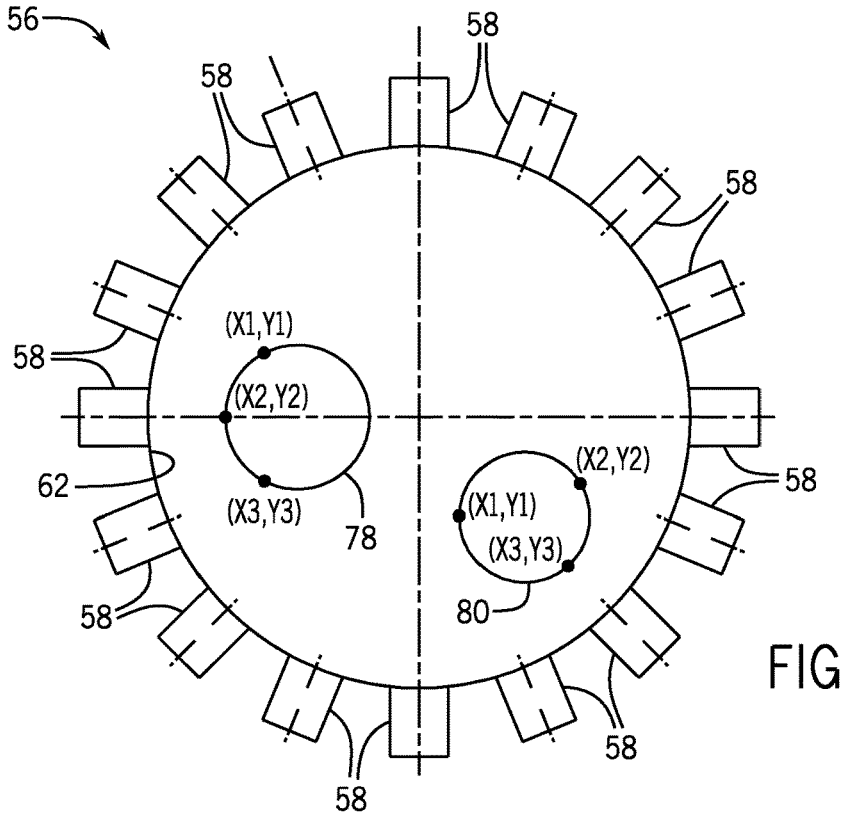
FIG. 7 shows multiple objects in the bore that can be characterized using a planar sensing array in accordance with one embodiment.

Although eight transducers 58 are depicted in FIGS. 3-6, the sensing array 56 can include any suitable number of transducers 58 in other embodiments. For instance, the sensing array 56 depicted in FIG. 7 includes sixteen transducers 58 positioned at 22.5-degree intervals about the circumference of the bore 62. In addition to the monitoring and detection of single objects in the bore 62, the techniques described above can also be used to detect and characterize multiple objects in the bore simultaneously. As generally illustrated in FIG. 7, points on each of bore objects 78 and 80 in the sensing plane could be located using the sensing array 56, allowing the position and size of the objects to be determined.

Multiple sensing arrays 56 can be provided at different axial locations along the bore 62 to facilitate detection and characterization of objects within the bore. A pair of sensing arrays 56 can be provided adjacent one another in the blowout preventer stack 26 or the LMRP 36, for instance. In one embodiment generally depicted in FIG. 8, a pair of sensing arrays 56 are positioned about the bore of a portion 86 of the well apparatus 10 (e.g., within a wall 88 of the blowout preventer stack assembly 24 or the riser 16). A drill string 90 is shown in the bore as having drill pipes 92 coupled to one another via a tool joint 94 having an upper shoulder 96 and a lower shoulder 98.

In at least some instances, one or both of the sensing arrays 56 can be used to trend a detected object's exterior geometry over time to determine the axial speed and direction of the object within the bore (e.g., up or down through the sensing planes of the sensing arrays 56). The tool joints 94 of the drill string 90 have a greater diameter compared to other portions of the drill string 90. As the drill string 90 moves axially through the bore, the change in the diameter of the drill string 90 within the sensing planes is detected by the sensing arrays 56.

Figure 8:
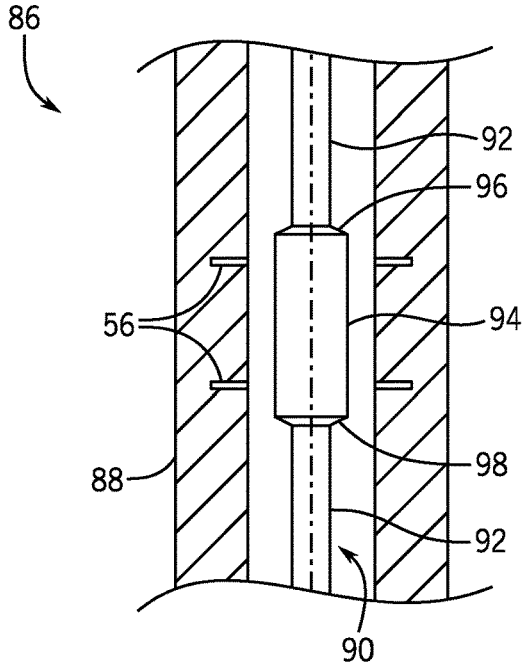
FIG. 8 is a cross-section of a portion of a well apparatus showing a pair of planar sensing arrays that can be used to detect the speed, direction, and vertical position of a tool joint of a drill string within the bore in accordance with one embodiment.
Figure 9:
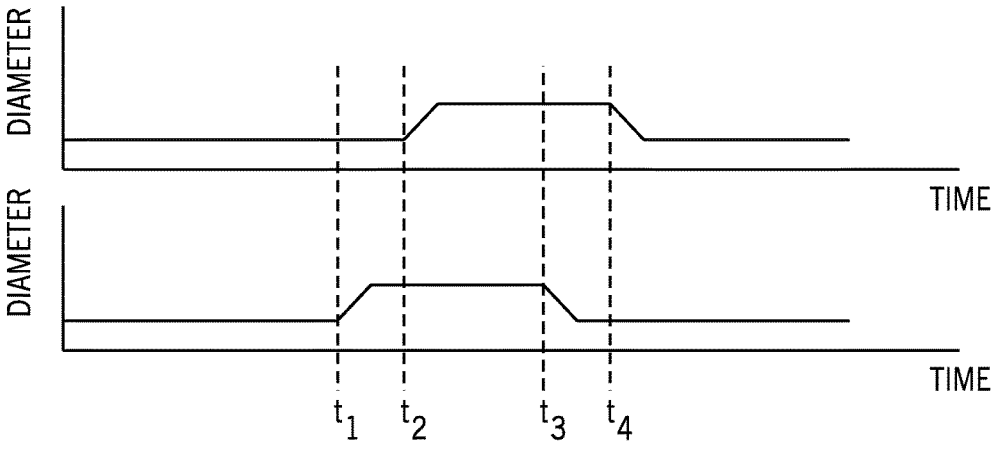
FIG. 9 represents the determined diameter of the drill string passing through sensing planes of the planar sensing arrays over time in accordance with one embodiment.

By way of example, the diameter of a drill string 90 determined with the upper and lower sensing arrays 56 of FIG. 8 over a period of time is generally represented in FIG. 9, with the upper plot representing the diameter determined from the upper sensing array 56 and the lower plot representing the diameter determined from the lower sensing array 56. As the drill string moves up the bore, a tool joint 94 would first enter the sensing plane of the lower sensing array 56 and then into the sensing plane of the upper sensing array 56. Referring to FIG. 9, the upper shoulder 96 of a tool joint 94 is detected by the lower sensing array 56 at time $t_1$ and by the upper sensing array 56 at time $t_2$. The axial speed of the tool joint 94 can be calculated from the elapsed time between times $t_1$ and $t_2$ and the known separation between the sensing planes of the upper and lower sensing arrays 56, while the direction can be determined from the sequence in which the shoulder is detected by the lower and upper sensing arrays 56. The lower shoulder 98 can be similarly detected by the lower and upper sensing arrays 56 at times $t_3$ and $t_4$, respectively, and can also or instead be used to determine the axial speed and direction of the tool joint 94. Using results for speed and direction based on both the upper and lower shoulders provides redundancy and enables self-checking for increased confidence in the determined results. The axial position of the tool joint within the bore (or of another object, such as a running tool in a wellhead bore) at some later time can be determined based on the calculated axial velocity of the object and the amount of time that has elapsed since the object was detected.

In other embodiments, the elapsed time between detection of upper and lower tool joint shoulders can be used with known lengths for the drill string (e.g., the length between the upper shoulder 96 and the lower shoulder 98) to determine the axial speed of the drill string. Lateral speed and direction of bore objects within a sensing plane of a sensing array 56 can also be determined, such as from changes in the calculated location of the center of a detected object within the sensing plane over time. In the case of non-circular objects, rotational speed and direction could also be determined from changes in the detected location and orientation over time.

Rather than merely detecting the presence of tool joints or other objects at an axial position in the bore, the present techniques can be used to generate a real-time location and outline of an object passing through the bore. The actual size of the object can also be measured using information from the sensing array 56. Further, characterization of the object may be performed without using prior knowledge of the shape of the object.

Various aspects of the characterization of the object within the bore can be visualized for use by an operator. For example, the data analyzer 50 can determine the position of a component (e.g., a tool joint) in the bore based on three or more points located on the exterior of the component, as described above, and then output a graphical indication of the component within the bore to an operator. In one instance, the graphical indication may include a depiction of a cross-section of the bore and the relative position and shape of the component within the bore. The graphical indication could include the detected coordinates. The axial position of an object (e.g., a tool joint) within the bore may also be depicted in graphical form, which may show the axial position of a tool joint relative to preventers or other components of the well apparatus 10.

The ultrasonic measurement of distances between the transducers 58 and objects detected within the bore depends on the velocity of sound within the bore. This velocity of sound may change as a result of changes in the transmission medium (e.g., changes in temperature or composition) in the bore, and an inaccurate estimate of the velocity of sound may negatively impact characterization of a bore object. Various in-situ techniques for determining the velocity of sound in the bore are described below in connection with FIGS. 10-12 and can be used for real-time calibration of the velocity of sound in the detection and characterization techniques described herein.

Figure 10:
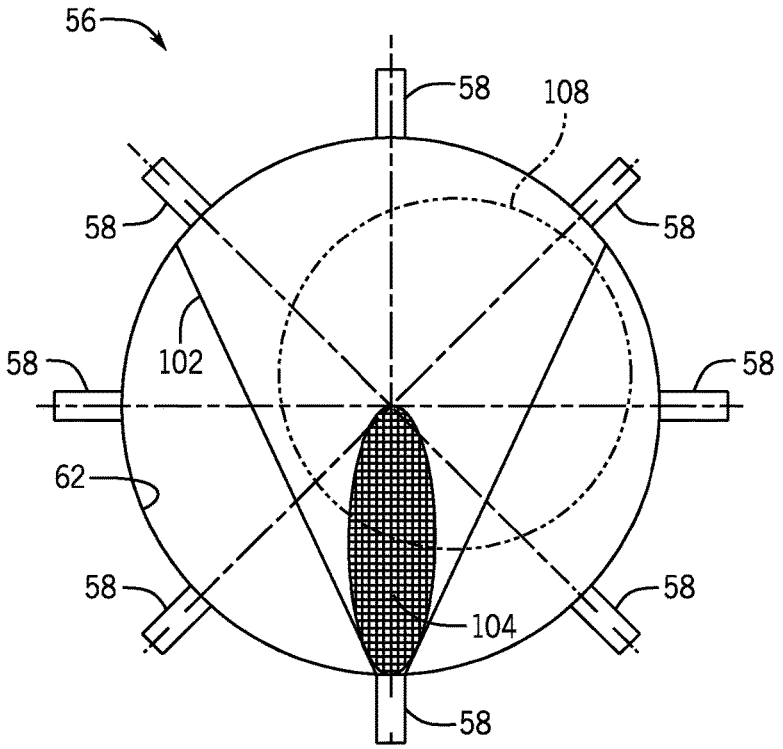
FIG. 10 depicts an ultrasonic beam that has been widened to direct ultrasonic energy toward multiple ultrasonic transducers in accordance with one embodiment.

In some embodiments, the majority of the energy projected by each ultrasonic transducer 58 is focused towards the center of the bore 62, but the beam pattern is widened so that a smaller proportion is directed towards another transducer 58 off the main axis of the beam. An example of this is generally depicted in FIG. 10, which shows a beam pattern 102 from the lowermost transducer 58 that has been widened to direct ultrasonic energy not only to the uppermost transducer 58, but also to transducers 58 to the left and right of the uppermost transducer 58. The majority of the ultrasonic energy is within a region 104 and is focused toward the center of the bore. The distances between the various transducers are known and the time of flight of each signal can be measured, allowing the velocity of sound through the bore to be calculated for each signal sent and received. If an object 108 is present within the bore and prevents transmission of ultrasonic signals along a shared axis between two opposing ultrasonic transducers (e.g., the uppermost and lowermost transducers in FIG. 10), the widened beam pattern 102 allows calculation of the velocity of sound based on communication of ultrasonic signals between the lowermost transducer and an off-axis transducer (i.e., the transducer forty-five degrees to the left of the uppermost transducer).

Figure 11:
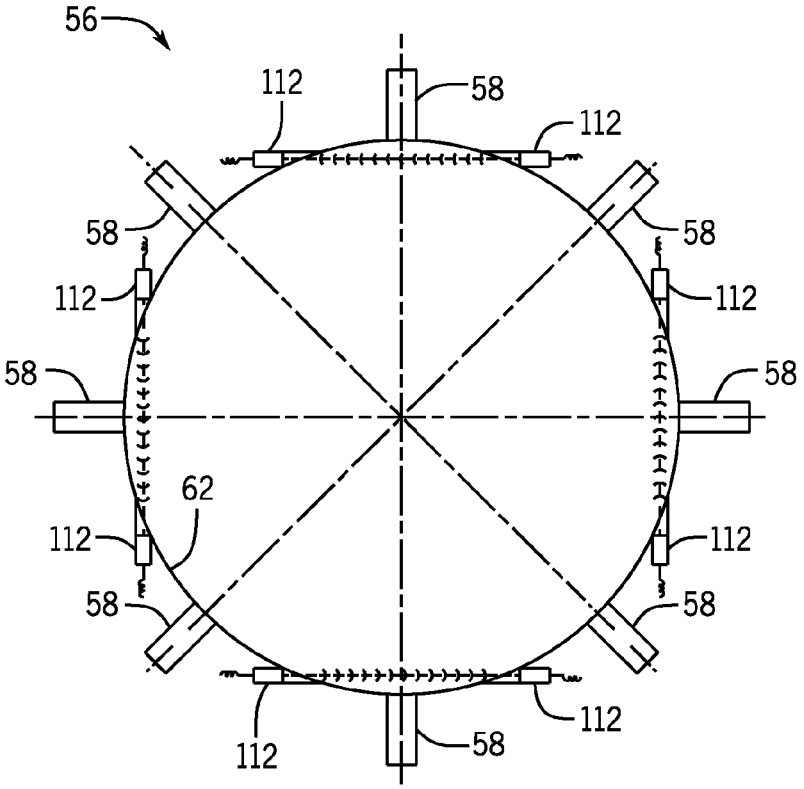
FIG. 11 illustrates additional ultrasonic transducers that may be used to determine the velocity of sound in the bore in accordance with one embodiment.

In another embodiment, such as that shown in FIG. 11, ultrasonic transducers 112 dedicated to measuring the velocity of sound are used in addition to the transducers 58. The transducers 112 can be provided in pairs to pass ultrasonic signals between the transducers 112 near the side wall of the bore 62 to reduce the likelihood that a bore object will impede this communication. In FIG. 11, multiple pairs of transducers 112 are positioned at different locations around the circumference of the bore 62. If a bore object impedes communication between one pair of transducers 112, another pair of transducers 112 can be used to measure the velocity of sound in the bore. The distances between the transducers 112 are also known, allowing the velocity of sound through the fluid in the bore to be calculated from the distances and the measured time of flight of the signals.

Figure 12:
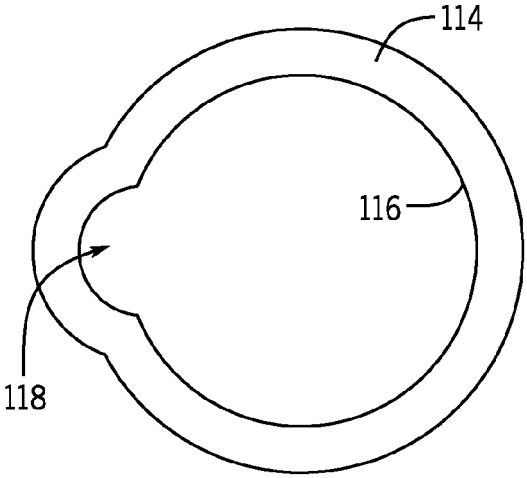
FIG. 12 depicts a well component, such as a portion of a blowout preventer stack or riser, having a bore with a recessed portion to facilitate measurement of the velocity of sound in the bore in accordance with one embodiment.

In some embodiments, the wall of the bore includes a recess to facilitate measurement of the velocity of sound in the bore. For instance, as shown in FIG. 12, a component 114 of the well apparatus 10 (e.g., of the riser 16 or the wellhead assembly 18) includes a bore 116 and a recess 118 in its inner wall. A pair of ultrasonic transducers 112 can be placed on opposite sides of the recess 118 to transmit ultrasonic waves through a representative sample of the fluid in the bore. As above, the known distance between the transducers and the measured time of flight of the signals can be used to determine the velocity of sound through the fluid.

While the presently disclosed systems and techniques can be used to determine the position, geometry, and velocity of objects within the bore of a blowout preventer, a riser, or some other component of a well apparatus, the determined information about the objects within the bore can be used in other ways as well. In some instances, the data collected with the sensing arrays 56 can be used in assessing fatigue and wear of components of blowout preventers, risers, or drill strings. One example of this is correlating the number of larger-diameter objects (e.g., tool joints of a drill string) that have passed through an annular preventer (e.g., preventer 32 or 38 of FIG. 2), along with the speed at which the objects passed through and the hydraulic pressure applied to the annular preventer at the time. That information can be combined to consider the impact of the passage of equipment on the packer in the annular preventer and thus be used for condition-based monitoring and predictive maintenance.

In some embodiments, one or more sensing arrays 56 are used in an interactive control system for an annular or other preventer. In such instances, the axial position of tool joints or other larger-diameter objects within the bore can be determined and then used to control operation of the preventers. In one example, the axial position of a tool joint can be used to time relaxation of pressure on a packer of a closed annular preventer to allow the tool joint to more easily pass through the preventer, and then increase of pressure on the packer once the tool joint has passed through.

Although various sensing arrays 56 are described above as having ultrasonic transducers, other embodiments for detecting and characterizing objects within the bore may not use ultrasound. For example, in one embodiment the sensing array 56 includes radio-frequency identification (RFID) readers rather than the ultrasonic transducers 58. By equipping each section of riser, drill pipe, and the like with an individually identifiable RFID tag and placing a ring of RFID readers (which may operate as bore object sensors 40 or 44) around the bore of the blowout preventer stack assembly (or of some other component of a well apparatus) in the manner described above for the ultrasonic sensing arrays, it is possible to detect each section of the string as it passes through the bore by the RFID readers. Axial speed and location of the tool joints can be determined based on the rate of RFID tag detection and known distances between the tags. In another embodiment, the sensing array 56 includes eddy-current sensors that can be used for determining the axial location, radial location, size, and shape of an object in the bore in a manner like that described above.

Figure 13:
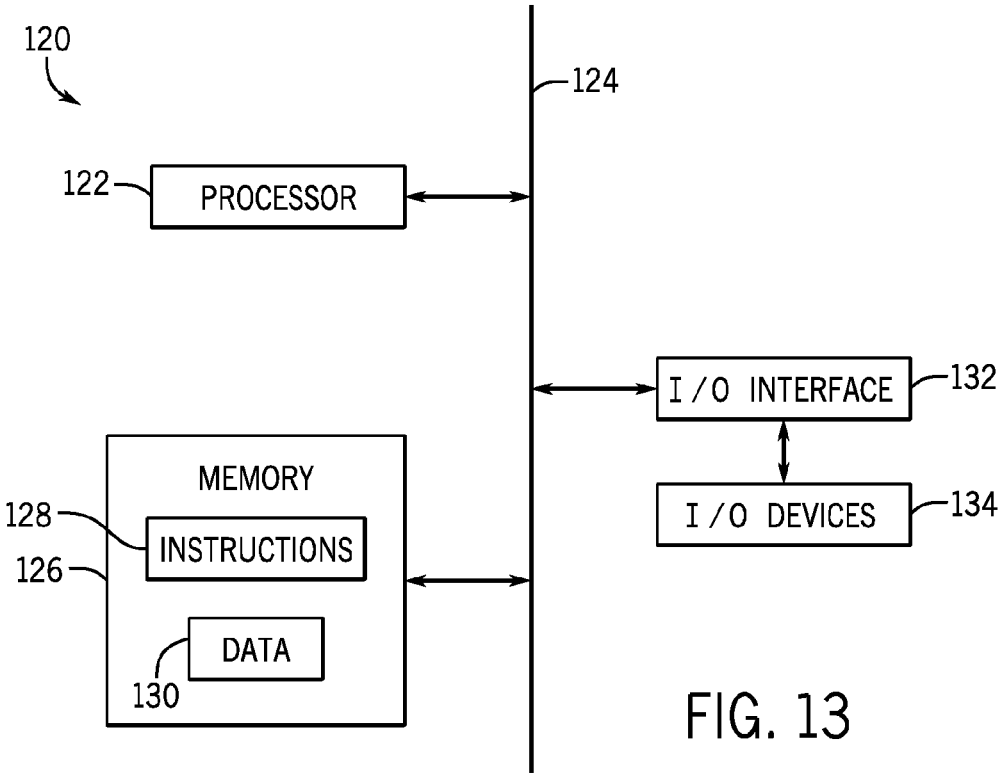
FIG. 13 is a block diagram of a programmable data analyzer that can be used to detect and characterize objects within the bore of a well apparatus in accordance with one embodiment.

Finally, it is noted that the data analyzer 50 for implementing various functionality described above can be provided in any suitable form. In at least some embodiments, such a data analyzer 50 is provided in the form of a processor-based system, an example of which is provided in FIG. 13 and generally denoted by reference numeral 120. In this depicted embodiment, the system 120 includes a processor 122 connected by a bus 124 to a memory device 126. It will be appreciated that the system 120 could also include multiple processors or memory devices, and that such memory devices can include volatile memory (e.g., random-access memory) or non-volatile memory (e.g., flash memory and a read-only memory). The one or more memory devices 126 are encoded with application instructions 128 (e.g., software executable by the processor 122 to perform various functionality described above), as well as with data 130 (e.g., distances between known components in the well apparatus). For example, the application instructions 128 can be executed to process data representative of ultrasonic waves received by a sensing array 56 to identify the radial and axial location of a component (e.g., a tool joint) within the bore of a well apparatus 10, to determine the size and shape of the detected component, and to determine the axial and lateral speed and direction of travel of the component within the bore. In one embodiment, the application instructions 128 are stored in a read-only memory and the data 130 is stored in a writeable non-volatile memory (e.g., a flash memory).

The system 120 also includes an interface 132 that enables communication between the processor 122 and various input or output devices 134. The interface 132 can include any suitable device that enables such communication, such as a modem or a serial port. The input and output devices 134 can include any number of suitable devices. For example, in one embodiment the devices 134 include one or more sensors 40 or 44 (e.g., the ultrasonic transducers 58) for providing input of data to be used by the system 120 to detect and characterize bore objects, a keyboard to allow user-input to the system 120, and a display or printer to output information from the system 120 to a user, such as a graphical indication of the location of the component within the bore. The input and output devices 134 can be provided as part of the system 120, although in other embodiments such devices may be separately provided.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method comprising:

emitting ultrasonic waves from a plurality of ultrasonic transducers into a bore of a well assembly;

receiving echoes of the ultrasonic waves reflected from first and second components in the bore of the well assembly; and processing the received echoes to determine positions of at least three different points of the exterior surface of the first component in the bore and to determine the presence of the first component and of the second component at a shared axial position in the bore.

2. The method of claim 1, comprising processing the received echoes to determine a size of the first component in the bore.

3. The method of claim 1, wherein the first component is a drill string.

4. The method of claim 3, wherein the first component is a tool joint of the drill string.

5. The method of claim 4, comprising processing the received echoes to determine at least one of an axial location or a radial location of the tool joint in the bore.

6. The method of claim 1, wherein receiving echoes of the ultrasonic waves includes receiving echoes of the ultrasonic waves via a sensing array provided in a blowout preventer stack assembly of the well assembly.

7. The method of claim 1, wherein receiving echoes of the ultrasonic waves includes receiving echoes of the ultrasonic waves via a sensing array provided in a riser of the well assembly.

8. The method of claim 1, wherein receiving echoes of the ultrasonic waves includes receiving echoes of the ultrasonic waves via a plurality of sensing arrays positioned at different axial locations along the bore of the well assembly.

9. The method of claim 8, wherein the plurality of sensing arrays includes a first sensing array provided in a blowout preventer stack assembly and a second sensing array provided at a different axial location in the blowout preventer stack assembly.

10. The method of claim 9, wherein the blowout preventer stack assembly is a subsea blowout preventer stack assembly.

11. The method of claim 1, comprising outputting a graphical indication of the position of the first component in the bore based on the determined positions of the at least three different points of the exterior surface of the first component.

12. The method of claim 1, wherein emitting ultrasonic waves from the plurality of ultrasonic transducers includes emitting ultrasonic waves having different acoustic signatures to enable identification of the received echoes of the ultrasonic waves as being from particular ultrasonic transducers of the plurality of ultrasonic transducers.

13. The method of claim 1, comprising processing the received echoes to determine a direction and a speed of travel of the first component in the bore.

14. The method of claim 1, comprising processing the received echoes to determine radial positions of the first and second components at the shared axial position in the bore.

15. A method comprising:

emitting ultrasonic waves from a plurality of ultrasonic transducers into a bore of a well assembly;

measuring a velocity of sound in the bore of the well assembly;

receiving echoes of the ultrasonic waves reflected from a component in the bore of the well assembly; and processing the received echoes to determine positions of at least three different points of the exterior surface of the component in the bore, wherein processing the received echoes includes using the measured velocity of sound in processing the received echoes to determine the positions of the at least three different points of the exterior surface of the component in the bore.

16. The method of claim 15, wherein measuring the velocity of sound in the bore of the well assembly includes calculating the velocity of sound based on ultrasonic signals from the plurality of ultrasonic transducers or calculating the velocity of sound based on ultrasonic signals from one or more additional ultrasonic transducers that are dedicated to measuring the velocity of sound.

17. The method of claim 16, wherein measuring the velocity of sound in the bore of the well assembly includes calculating the velocity of sound based on communication of an ultrasonic signal between a pair of ultrasonic transducers that do not share a common axis.

18. A method comprising:

emitting ultrasonic waves from a plurality of ultrasonic transducers into a bore of a well assembly;

receiving echoes of the ultrasonic waves reflected from a component in the bore of the well assembly;

processing the received echoes to determine positions of at least three different points of the exterior surface of the component in the bore and to determine an axial position of the component in the bore; and automatically controlling operation of an annular preventer of the well assembly in response to the determined axial position of the component in the bore.

* * * * *